US006898929B2

(12) United States Patent
Asmus et al.

(10) Patent No.: US 6,898,929 B2
(45) Date of Patent: May 31, 2005

(54) METHOD AND APPARATUS FOR SUPPLYING A REDUCTANT TO AN ENGINE EXHAUST TREATMENT SYSTEM

(75) Inventors: Thomas W Asmus, Oakland, MI (US); Fuquan Zhao, Troy, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 30 days.

(21) Appl. No.: 10/606,012

(22) Filed: Jun. 25, 2003

(65) Prior Publication Data

US 2004/0261403 A1 Dec. 30, 2004

(51) Int. Cl.[7] ..... F01N 3/00

(52) U.S. Cl. ..... 60/286; 60/283; 60/295; 60/303

(58) Field of Search ..... 60/274, 283, 286, 60/295, 297, 303

(56) References Cited

U.S. PATENT DOCUMENTS

| | | | | |
|---|---|---|---|---|
| 5,406,790 A | | 4/1995 | Hirota et al. | |
| 5,809,774 A | * | 9/1998 | Peter-Hoblyn et al. | 60/274 |
| 5,921,076 A | | 7/1999 | Krutzsch et al. | |
| 5,924,280 A | * | 7/1999 | Tarabulski | 60/274 |
| 5,976,475 A | * | 11/1999 | Peter-Hoblyn et al. | 423/212 |
| 6,276,310 B1 | * | 8/2001 | Backes et al. | 123/1 A |
| 6,739,126 B2 | * | 5/2004 | Huthwohl | 60/286 |

OTHER PUBLICATIONS

"Regeneration Strategies for NOx Adsorber Catalysts" Owen H. Balley et al., SAE Technical Paper Series 972845; reprinted from "Topics in General and Advanced Emissions" (SP–1296); Oct. 13–16, 1997.

"Study of Factors Influencing the Performance of a NOx Trap in a Light–Duty Diesel Vehicle" Yuejin, et al.; SAE Technical Paper Series 2000–01–2911; Oct. 16–19, 2000.

"High–Efficiency NOx and PM Exhaust Emission Control for Heavy–Duty On–Highway Diesel Engines" Charles Schenck et al., SAE Technical Paper Series 2001–01–1351; Mar. 5–8, 2001.

* cited by examiner

*Primary Examiner*—Binh Q. Tran
(74) *Attorney, Agent, or Firm*—Ralph E. Smith

(57) ABSTRACT

A method and apparatus for providing a vaporized reductant to an engine exhaust stream find particular utility in the regeneration of a nitrous oxide absorber in a Diesel engine exhaust treatment system. The method and apparatus are based on fueling the Diesel engine with a mixture of Diesel oil and an alcohol, such as methanol. At least a portion of the alcohol vaporizes in the fuel tank, or is forced to vaporize by passing the fuel mixture through a heat exchanger. The vapor is then stored in a canister for subsequent selective injection of the alcohol into the exhaust stream upstream of the adsorber. The alcohol then thermally decomposes to provide sufficient hydrogen and carbon monoxide to regenerate the adsorber.

29 Claims, 2 Drawing Sheets

METHOD AND APPARATUS FOR SUPPLYING A REDUCTANT TO AN ENGINE EXHAUST TREATMENT SYSTEM

BACKGROUND OF THE INVENTION

The invention generally relates to exhaust emission treatment for Diesel engines. More specifically, the invention concerns a method and apparatus for regeneration of a nitrous oxide (NOx) adsorbent placed in the exhaust stream of a Diesel engine.

It is well known that Diesel engines emit significant quantities of NOx and that these engines produce exhaust that is characteristically lean—i.e. the exhaust contains significant quantities of oxygen. These combined conditions make acceptable exhaust after-treatment of NOx hard to achieve, in that conducting chemical reduction in an oxidizing atmosphere is difficult. Perhaps the most promising approach to meeting the NOx emissions objective is by means of an NOx adsorber which must be periodically regenerated with chemical reductants. The traditional reductant of choice has been the Diesel fuel itself which, when injected into the exhaust stream upstream of the NOx adsorber is, ideally, thermally modified to hydrogen and carbon monoxide, which are the active reducing chemical species. See for example, U.S. Pat. No. 5,406,790 to Hirota, et al. It is also well known that hydrogen is the most effective reducing agent, followed by mixtures of hydrogen and carbon monoxide, followed by carbon monoxide alone, and followed by light hydrocarbon species. For a combination of reasons, this approach has not been commercially successful.

NOx adsorber performance is highly contingent upon very low sulphur exposure and upon the efficiency of the regeneration process. Regeneration of the adsorber is the subject of this invention.

Diesel fuel has conventionally been used as the reductant by introducing fuel to the exhaust stream at one of two locations. The first location is at the engine where the same injection equipment used for fueling the engine is used at a different time—the post combustion regime—to introduce the fuel to the exhaust stream. Injecting in this manner leads to problems of oil dilution, particulate formation and a molar hydrogen-to-carbon monoxide ratio derived from the Diesel fuel of less than one.

The second conventional fuel injection site is downstream of the engine and up-stream of the NOx adsorber. Injection at this location leads to problems of particulate formation, deposit formation in the injector nozzle, and a low molar hydrogen-carbon monoxide ratio.

In addition, both of these methods produce a hydrocarbon emission which must be resolved with a downstream oxidation catalyst. Also, because of the so-called hydrocarbon slip, there is an excessive fuel economy penalty in the range of 3–7% associated with this approach of using the fuel itself as the reductant source.

Therefore, there is seen to be a need in the prior art for a method and arrangement for supplying a reductant to an exhaust stream, for example to effect NOx adsorber regeneration with a minimum of required new fueling system infrastructure and with no appreciable impact on fuel economy.

SUMMARY OF THE INVENTION

In one aspect of the invention, a method for providing a reductant to an engine exhaust stream of a vehicle begins with placing a mixture into a fuel tank of the vehicle, the mixture comprising fuel normally used by the engine of the vehicle and a liquid reductant which is compatible with the fuel but of higher volatility than the fuel. Vaporized reductant is recovered and stored in a storage device. The reductant is then selectively injected into the exhaust stream.

In another aspect of the invention, an arrangement for providing a reductant to an engine exhaust stream of a vehicle includes a fuel tank containing a mixture of fuel normally used by the engine of the vehicle and a liquid reductant which is compatible with the fuel but of higher volatility than the fuel. A storage device is coupled for receipt of reductant vapor derived from the mixture, and an injection conduit couples the storage device to the engine exhaust stream.

In yet another aspect of the invention, a method for regeneration of a nitrous oxide adsorber in a Diesel engine exhaust treatment system of a vehicle begins with fueling the engine from a fuel tank of the vehicle containing a mixture of Diesel oil and an alcohol. Vaporized alcohol is recovered and stored in a storage container. Regeneration is initiated by injecting the alcohol from the storage device into an exhaust stream upstream of the adsorber whereby the alcohol thermally decomposes to produce sufficient hydrogen and carbon monoxide to regenerate the adsorber.

In still another aspect of the invention, an arrangement for effecting regeneration of a nitrous oxide adsorber in a Diesel engine exhaust treatment system includes a fuel tank containing a fuel mixture of Diesel oil and an alcohol. A storage device is coupled for receipt of alcohol vapor derived from the fuel mixture. An alcohol injection conduit couples the storage device to an engine exhaust stream at an inlet to the nitrous oxide adsorber.

Further areas of applicability of the present invention will become apparent from the detailed description provided hereinafter. It should be understood that the detailed description and specific examples are intended for purposes of illustration only and are not intended to limit the scope of the invention.

BRIEF DESCRIPTION OF THE DRAWING

The objects and features of the invention will become apparent from a reading of a detailed description, taken in conjunction with the drawing, in which.

DETAILED DESCRIPTION

Figure 1:
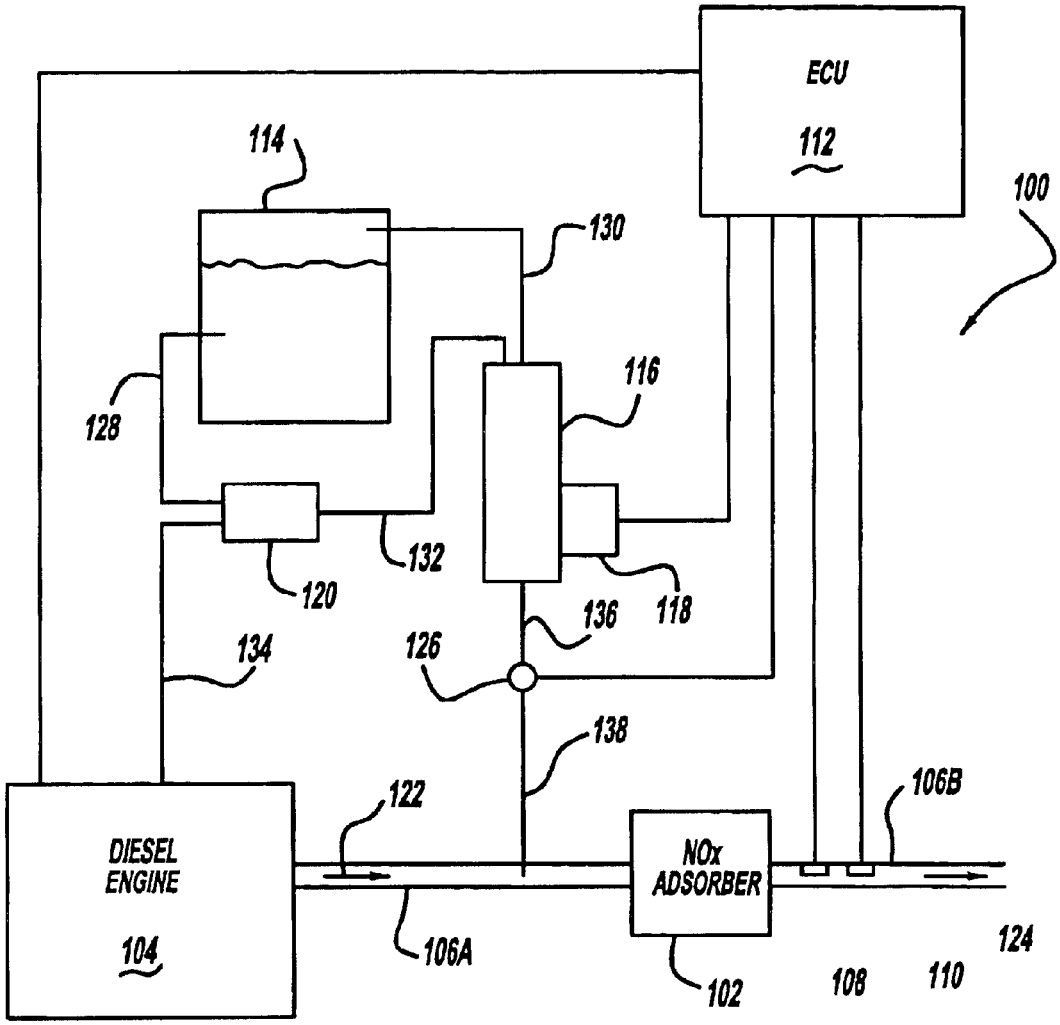
FIG. 1 is a block diagram of a system arranged in accordance with the principles of the invention.

With reference to FIG. 1, Diesel exhaust treatment arrangement 100 utilizes an NOx adsorber 102 positioned in an exhaust conduit leading from Diesel engine 104. Adsorber 102 is positioned between exhaust conduit portions 106A and 106B, and the exhaust stream flows in the directions indicated by arrows 122 and 124.

Positioned in conduit 106B downstream of NOx adsorber 102 are an oxygen sensor 108 and an NOx sensor 110 whose outputs are coupled for receipt by an engine control unit 112.

The fuel tank 114 of the vehicle receives a mixture of Diesel oil and an alcohol, such as methanol or ethanol. Methanol is preferred as an abundant low cost alcohol derived from either natural gas or coal. Methanol has several very desirable characteristics making it particularly suitable for use in the invention. Methanol readily breaks down into hydrogen and carbon monoxide in the temperature range characteristic of Diesel engine exhaust. This thermal decomposition yields a molar hydrogen-carbon monoxide ratio of two, and this is much more favorable than that derived from Diesel fuel alone. Additionally, alcohols, such as methanol, form neither particulate matter or deposits when exposed to temperatures characteristic of a Diesel exhaust system. Furthermore, methanol is sufficiently soluble in Diesel fuel to enable the requisite quantity of this material to be conveyed to a vehicle via the engine fuel itself. Hence, due to these compatibility characteristics of alcohol mixed with Diesel fuel, no additional fluid need be separately added to a vehicle to maintain NOx adsorber functionality.

Due to the volatility difference between Diesel oil and an alcohol such as methanol, the higher volatility methanol can be stripped from the vapor space of fuel tank 114 in an area above the liquid level and stored in a storage device such as a charcoal canister 116 of the type used in gasoline-powered vehicles for evaporative emissions control. Vapor line 130 takes methanol vapor from tank 114 and stores it in charcoal canister 116. Alternatively, as the fuel is delivered to engine 104 via fuel line 128, it may be optionally diverted first to a heat exchanger 120 prior to delivery of the Diesel fuel via line 134 to engine 104. Heat exchanger 120 then would forcibly vaporize at least a portion of the alcohol in the fuel mixture and conduct this vapor via conduit 132 to another input of canister 116.

Methanol is then conveyed from canister 116, either as vapor or liquid or a combination of both, to exhaust conduit 106A upstream of the NOx adsorber 102 by a pump 118 such an electric scavenge pump controlled via engine control unit 112. The methanol is then injected into the exhaust stream via conduit 136 through a metering valve 126 and thence through a vapor conduit 138 into conduit 106A. Metering valve 126 controls the flow rate of methanol to the exhaust system. Oxygen sensor 108 provides a control input for the methanol metering valve, such as via engine control unit 112 to ensure that the correct amount of methanol is delivered to the adsorber during the regeneration period. Any surplus alcohol, such as ethanol or methanol, not needed for NOx adsorber regeneration will simply be burned in the Diesel engine's combustion chamber just as any other compatible fuel component is consumed.

Figure 2:
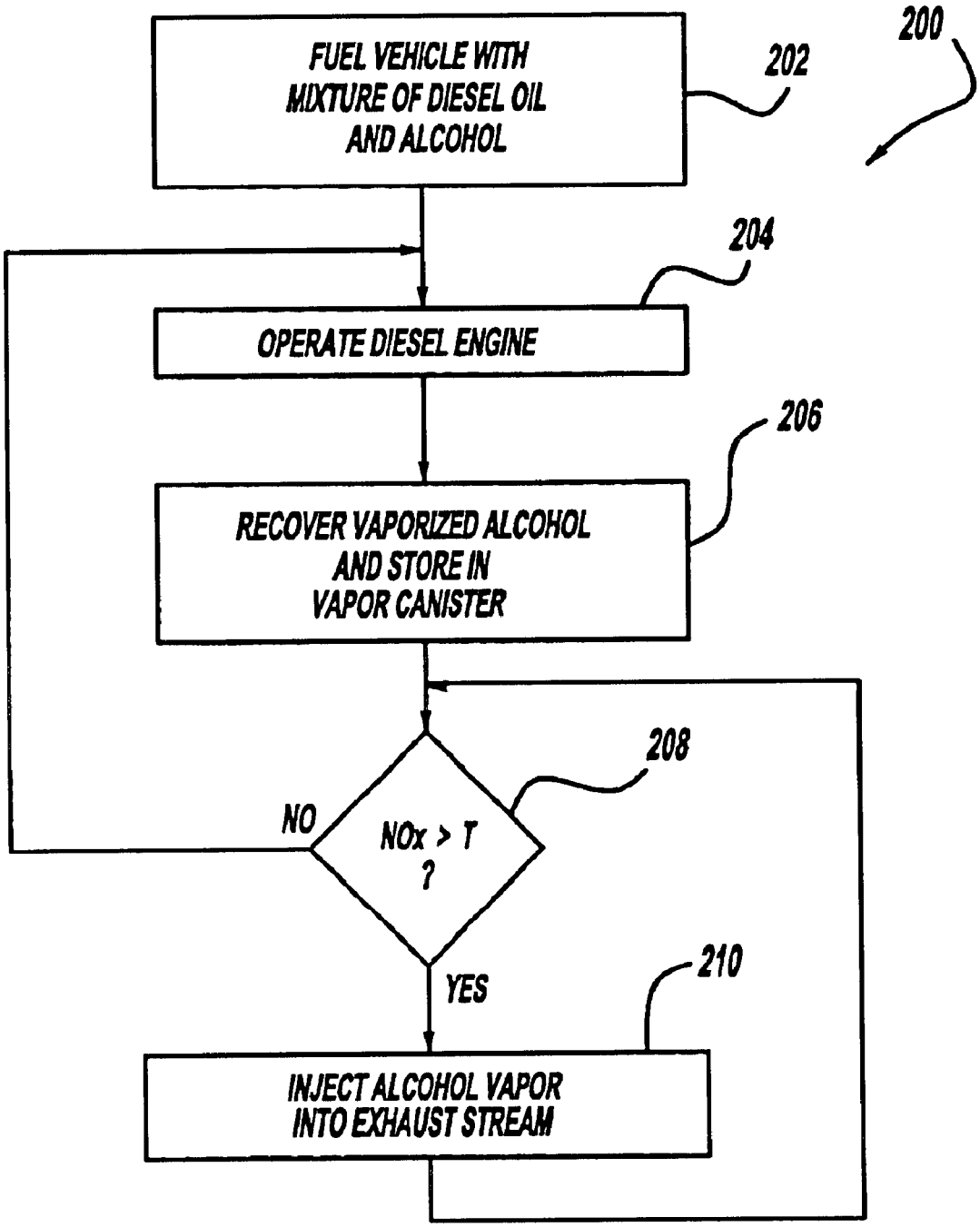
FIG. 2 is a flowchart of a method of the invention.

With reference to the flowchart of FIG. 2, the arrangement of FIG. 1 is utilized to effect the regeneration method set forth in FIG. 2. Method 200 begins at step 202 by fueling the vehicle with a mixture of Diesel oil and alcohol, such as methanol. At step 204 the engine is operated as normal. At step 206 vaporized alcohol is recovered and stored in vapor canister 116. This recovery, as explained above, can take place either from the natural evaporation of the methanol while in the tank under normal vehicle operating conditions, or alternatively, the fuel can be directed through a heat exchanger where the alcohol is intentionally vaporized and stored in canister 116.

At decision step 208 the NOx sensor 110 will deliver a predetermined signal level to engine control unit 112 whenever the nitrous oxide level downstream of adsorber 102 exceeds a predetermined threshold T. For so long as this threshold is not exceeded, then normal engine operation will continue at step 204. When threshold T is exceeded, control unit 112 first adjusts the engine to operate in a richer, preferably stoichiometric, mode to precondition the adsorber for regeneration. Then engine control unit 112 will enable pump 118 to inject alcohol as vapor or liquid or a combination thereof into the exhaust stream via metering valve 126 whose flow rate establishment mechanism is a function of the oxygen level in the exhaust stream downstream of the NOx adsorber 102 as detected by oxygen sensor 108. The alcohol will then thermally decompose into the desired reducing agents. The regeneration process will continue for so long as the nitrous oxide level is above the threshold value. Alternatively, a preselected constant time period may be used for the regeneration periodic process.

It therefore becomes apparent that the invention features the following favorable characteristics in a nitrous oxide absorbent regeneration system.

An alcohol, such as methanol preferably or ethanol, readily breaks down into hydrogen and carbon monoxide in the temperature range characteristic of Diesel engine exhaust operating conditions.

The thermal decomposition of the alcohol yields a molar hydrogen-to-carbon monoxide ratio of approximately two, and this is much more favorable than that derived from Diesel fuel alone.

The alcohol forms neither particulate matter nor deposits when exposed to temperatures characteristic of Diesel exhaust.

Alcohol, such as methanol, is sufficiently soluble in Diesel fuel to eliminate the need for adding the reductant source separately to the vehicle.

Any surplus alcohol, such as methanol, not needed for NOx adsorber regeneration will simply be burned in the combustion chamber of the Diesel engine.

Finally, as the regeneration efficiency of the methanol-based reductant system is higher than that of its Diesel fuel counterpart, the invention performs the required regeneration process at a lower fuel penalty than that of the Diesel fuel approach.

The description of the invention is merely exemplary in nature and, thus, variations that do not depart from the gist of the invention are intended to be within the scope of the invention. Such variations are not to be regarded as a departure from the sprit and scope of the invention.

We claim:

1. A method for providing a reductant to an engine exhaust stream of a vehicle, the method comprising:

placing a mixture into a fuel tank of the vehicle, the mixture comprising fuel normally used by the engine of the vehicle and a liquid reductant which is compatible with the fuel but of higher volatility than the fuel;

recovering vaporized reductant emitted by the liquid reductant and storing the vaporized reductant in a storage device; and selectively injecting the reductant into the exhaust stream.

2. The method of claim 1, wherein the vaporized reductant is recovered directly from the fuel tank.

3. The method of claim 1, wherein the vaporized reductant is recovered by passing the mixture through a heat exchanger.

4. A method for regeneration of a nitrous oxide adsorber in a Diesel engine exhaust treatment system, the method comprising:

fueling the engine from a fuel tank of the vehicle containing a mixture of Diesel oil and an alcohol;

recovering vaporized alcohol and storing the vaporized alcohol in a storage device; and initiating regeneration by injecting alcohol in the storage device into an exhaust stream upstream of the adsorber, whereby the alcohol thermally decomposes to produce sufficient hydrogen and carbon monoxide to regenerate the adsorber.

5. The method of claim 4, wherein the alcohol comprises methanol.

6. The method of claim 4, wherein the alcohol comprises ethanol.

7. The method of claim 4, further comprising monitoring the exhaust stream at an output of the adsorber and initiating regeneration whenever a level of nitrous oxide exceeds a predetermined threshold value.

8. The method of claim 4, further comprising:

monitoring oxygen content of the exhaust stream at an output of the adsorber and determining an amount of alcohol vapor to be injected in accordance with the oxygen content.

9. The method of claim 8, wherein the amount of alcohol vapor is determined by controlling flow rate of injected alcohol vapor to the exhaust stream.

10. The method of claim 4, wherein the storage device comprises a charcoal canister.

11. The method of claim 4, wherein vaporized alcohol is recovered directly from the fuel tank.

12. The method of claim 4, wherein vaporized alcohol is recovered by passing the mixture of Diesel oil and alcohol through a heat exchanger.

13. The method of claim 4, wherein alcohol from the storage device is injected in vapor form into the exhaust stream.

14. The method of claim 4, wherein alcohol from the storage device is injected in liquid form into the exhaust stream.

15. The method of claim 4, wherein alcohol from the storage device is injected in both vapor and liquid form into the exhaust stream.

16. An arrangement for providing a reductant to an engine exhaust stream of a vehicle, the arrangement comprising:

a fuel tank containing a mixture of fuel normally used by the engine of the vehicle and a liquid reductant which is compatible with the fuel but of higher volatility than the fuel;

a storage device coupled for receipt of reductant vapor derived from the mixture; and an injection conduit coupling the storage device to the engine exhaust stream.

17. The arrangement of claim 16, further comprising a vapor conduit having a first end located in the fuel tank above a liquid level of the mixture and a second end coupled to the storage device.

18. The arrangement of claim 16, further comprising a heat exchanger coupled to a fuel line extending between the engine and the fuel tank, the heat exchanger operative to vaporize at least a portion of the liquid reductant in the mixture, and a vapor conduit coupled between the heat exchanger and the storage device.

19. An arrangement for effecting regeneration of a nitrous oxide adsorber in a Diesel engine exhaust treatment system, the arrangement comprising:

a fuel tank containing a fuel mixture of Diesel oil and an alcohol;

a storage device coupled for receipt of alcohol vapor derived from the mixture; and an alcohol injection conduit coupling the storage device to an engine exhaust stream at an inlet to the nitrous oxide adsorber.

20. The arrangement of claim 19, further comprising a pump coupled to the storage device and operative to drive alcohol out of the storage device into the injection conduit.

21. The arrangement of claim 20, further comprising a metering valve located in the injection conduit and operative to control flow rate therethrough.

22. The arrangement of claim 21, further comprising an engine control unit coupled to the metering valve and the pump for selective operation thereof.

23. The arrangement of claim 22, further comprising a nitrous oxide sensor positioned in the engine exhaust stream at an output of the nitrous oxide adsorber and having an output coupled to the engine control unit, the engine control unit operative to actuate the pump to deliver alcohol to the exhaust stream whenever a level of nitrous oxide detected by the nitrous oxide sensor exceeds a predetermined threshold value.

24. The arrangement of claim 22, further comprising an oxygen sensor positioned in the engine exhaust stream at an output of the nitrous oxide adsorber and having an output coupled to the engine control unit, the engine control unit operative to adjust the metering valve in accordance with a level of oxygen detected by the oxygen sensor.

25. The arrangement of claim 19, further comprising a vapor conduit having a first end located in the fuel tank above a liquid level therein and a second end coupled to the storage device.

26. The arrangement of claim 19, further comprising a heat exchanger coupled to a fuel line extending between the Diesel engine and the fuel tank, the heat exchanger operative to vaporize at least a portion of the alcohol in the fuel mixture, and a vapor conduit coupled between the heat exchanger and the storage device.

27. The arrangement of claim 19, wherein the alcohol comprises methanol.

28. The arrangement of claim 19, wherein the alcohol comprises ethanol.

29. The arrangement of claim 19, wherein the storage device comprises a charcoal canister.

* * * * *